United States Patent [19]

Freudenschuss et al.

[11] Patent Number: 4,715,541

[45] Date of Patent: Dec. 29, 1987

[54] FUEL INJECTION NOZZLE FOR COMBUSTION ENGINES

[75] Inventors: Otto Freudenschuss, Vienna; Günther Herdin, Steyr; Harald Schmidt, Vienna; Emerich Schreiner, Steyr, all of Austria

[73] Assignee: Steyr-Daimler-Puch AG, Vienna, Austria

[21] Appl. No.: 833,218

[22] Filed: Feb. 25, 1986

[30] Foreign Application Priority Data

Feb. 26, 1985 [AT] Austria ..... 566/85
Nov. 8, 1985 [AT] Austria ..... 3231/85

[51] Int. Cl.[4] ..... F02M 45/00
[52] U.S. Cl. ..... 239/533.4; 239/533.9
[58] Field of Search ..... 222/491, 494, 496, 497; 239/533.2, 533.3, 533.4, 533.5, 533.6, 533.7, 533.8, 533.9, 533.11, 533.12

[56] References Cited

U.S. PATENT DOCUMENTS 1,735,718 11/1929 Attendu ..... 239/533.5
4,168,804 9/1979 Hofmann ..... 239/533.11
4,470,548 9/1984 Ushimura ..... 239/533.3
4,540,126 9/1985 Yoneda et al. ..... 239/533.4

FOREIGN PATENT DOCUMENTS 0217250 2/1961 Fed. Rep. of Germany .
2324475 1/1974 Fed. Rep. of Germany .
2711350 9/1978 Fed. Rep. of Germany .
3239461 5/1983 Fed. Rep. of Germany .
3239462 5/1983 Fed. Rep. of Germany .
1284797 8/1972 United Kingdom .
1418574 12/1975 United Kingdom .
2074234 10/1981 United Kingdom .

*Primary Examiner*—Robert J. Spar
*Assistant Examiner*—Jay I. Alexander
*Attorney, Agent, or Firm*—Marmorek, Guttman & Rubenstein

[57] ABSTRACT

A fuel injection nozzle for internal combustion engines comprises a nozzle body (1) and a nozzle needle (5) guided therein. The nozzle body (1) terminates in a nozzle cap (3) in which ejection bores (4) are provided and which forms at the inside a conical valve seat (6) against which the nozzle needle (5) is pressed. The nozzle needle (5) lifts under the pressure of the fuel supplied in a first lifting phase against the force of a spring (8) off the valve seat (6) and bears on a stop (19). This stop (19) is limitedly displaceable in a second lifting phase against the force of a further spring (9). To reduce the hydrocarbon emissions in the exhaust gases of the internal combustion engine and diminish ignition noise, the generated surface (M) of the imaginary cylinder formed in extension of the ejection bore (4) between the inner edge (R) thereof and the surface of the nozzle needle (5) lifted off the valve seat in the first lifting phase is made smaller than the cross-section of the ejection bore (4).

5 Claims, 4 Drawing Figures

Figure 1:
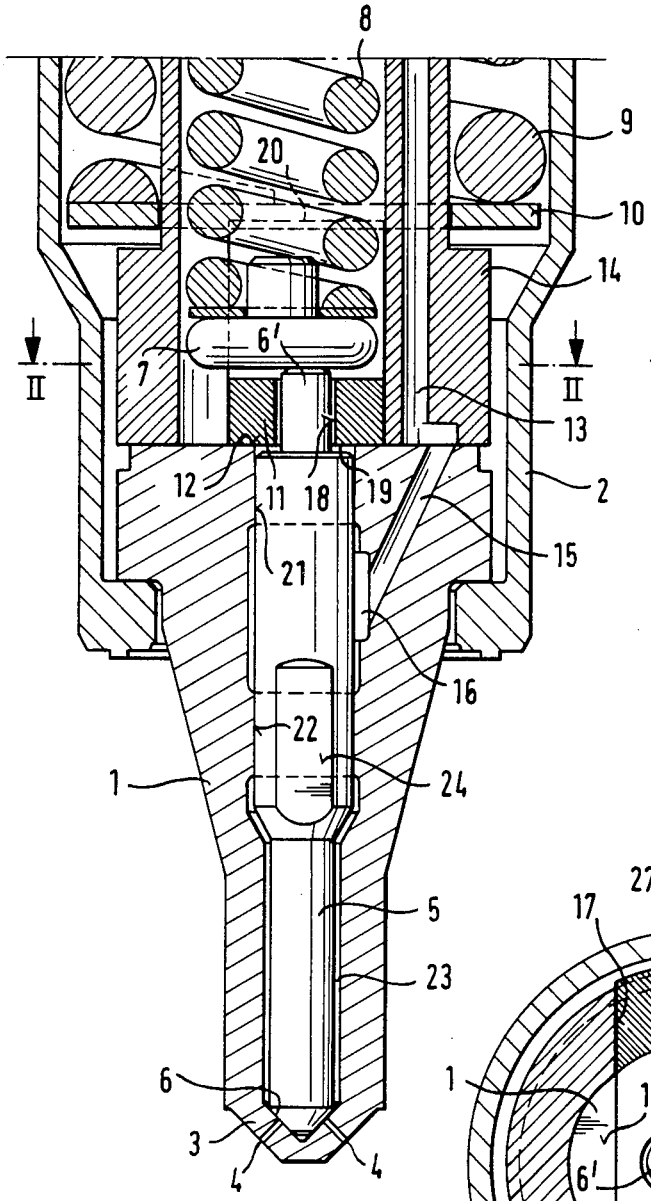

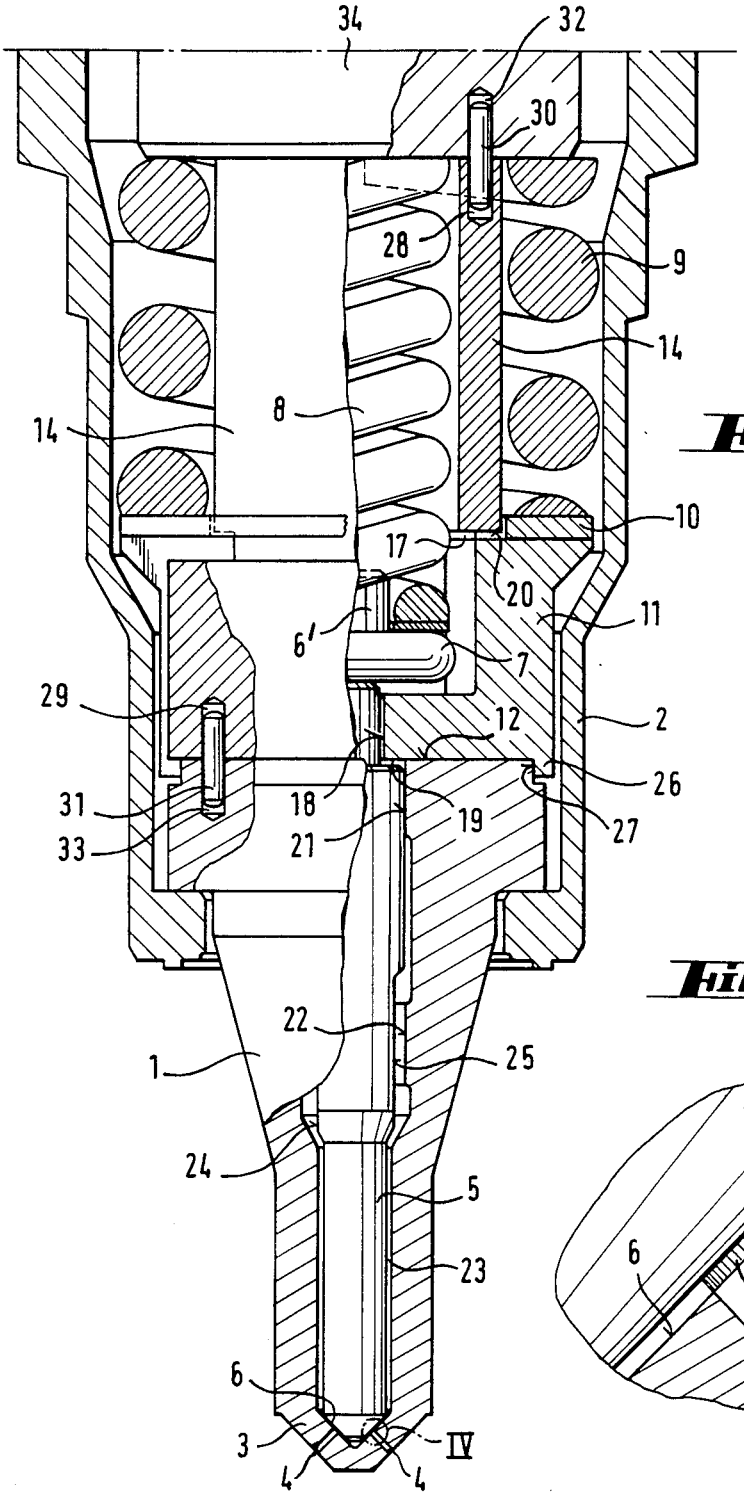
Fig. 3
Fig. 4
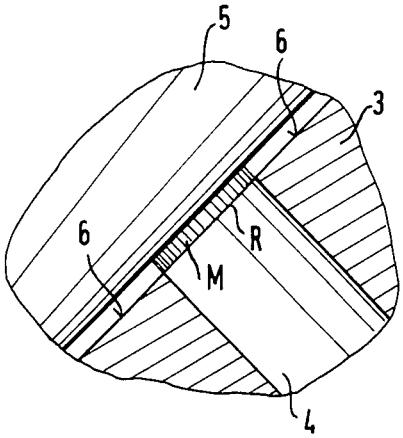

FUEL INJECTION NOZZLE FOR COMBUSTION ENGINES

The invention relates to a fuel injection nozzle for internal combustion engines comprising a nozzle body terminating in a nozzle cap having ejection bores and a nozzle needle which is guided in said body, pressed resiliently against a valve seat in the nozzle cap and under the pressure of the fuel supplied in a first lifting phase lifted off the valve seat against the force of a spring and engages in a stop which in turn is limitedly displaceable in a second lifting phase against the force of a further spring.

In a known fuel injection nozzle of this type (DE-OS No. 2,711,350) the ejection bores of the nozzle cap are disposed in at least two planes normal to the cap axis. Thus, in the first lifting phase only the ejection bores nearest the cap apex are released, the release of the ejection bores more remote from the cap apex not taking place until the second lifting phase. The purpose of the two springs acting in succession is to impart to the nozzle needle the function of a control member and the intention is not to influence the pollutant emissions of the internal combustion engine or the noise generated thereby. In any case, a disadvantage is that on opening of the ejection holes disposed in the second plane normal to the cap axis an unfavourable irregular point in the characteristic of the delivery amount results.

In a known fuel injection nozzle having altogether only one spring loading the nozzle needle (DE-OS No. 3,239,462) said nozzle needle is provided with a conical tip which when the nozzle is closed bears against the likewise conical valve seat in the nozzle body, the ejection bores being disposed in the region of the conical valve seat. The conical needle tip is followed by a cylindrical portion which widens again conically up to the full needle diameter of the then cylindrical needle. The conical valve seat is followed corresponding to the cylindrical needle portion by a hollow cylindrical zone which merges into a conical zone, said conical zone then opening with a comparatively large step to a cylindrical cavity. Of course, between the cylindrical portion of the nozzle needle and the hollow cylindrical zone of the nozzle body and between the following conical portions of the nozzle needle and the nozzle body gaps are present in annular form to permit the fuel exit from the cylindrical nozzle body cavity to the ejection bores. The annular gap between the cylindrical needle portion and the hollow cylindrical zone of the nozzle body has a cross-section whose area is less than the total cross-sectional area of the ejection bores. With this nozzle configuration it is achieved that the amount of ejected fuel after a brief rise on initial lifting of the nozzle needle from the valve seat remains constant over a predetermined lifting travel of the nozzle needle because for this fuel amount the gap between the cylindrical portion of the needle and the hollow cylindrical zone of the nozzle body is decisive and the gap width does not change as long as the cylindrical nozzle needle portion is still disposed in the hollow cylindrical nozzle body zone. Only when this phase terminates on further needle lifting does a pronounced rise of the ejected fuel amount occur. Apart from the fact that the change from conical and cylindrical portions and zones of the nozzle needle and nozzle body presents considerable manufacturing difficulties, if as necessary the annular gap between the cylindrical portion of the nozzle needle and the hollow cylindrical zone of the nozzle body has a considerable distance from the ejection bores whilst the gap between the conical needle tip and the conical needle seat becomes greater, the flow conditions to the ejection bores are improved and as a result the turbulences favouring fuel atomization reduced. The fuel therefore forms substantially laminar jets which impinge on the wall of the combustion chamber up to the piston of the internal combustion engine. Consequently, at the combustion chamber wall part of the fuel can deposit and this impairs complete fuel combustion, particularly at low speeds and small loads, and leads to higher hydrocarbon emissions in the exhaust gases. Since under high loads the phase with constant injection amount must also be traversed the injection duration is correspondingly longer and this results in increased smoke emission and increased fuel consumption.

The invention is based on the problem of further developing the fuel injection nozzle outlined at the beginning in such a manner that the hydrocarbon emissions in the exhaust gases are reduced and the noise generated is also diminished.

The invention solves the problem set in that for each bore the generated surface of the imaginary cylinder formed in extension of the ejection bore between the inner edge thereof and the surface of the nozzle needle lifted off the valve seat in the first lifting phase is made smaller than the cross-section of the ejection bore.

Since therefore in the first lifting phase for each bore the generated surface of the imaginary cylinder formed between the edge of the ejection bore and the surface of the nozzle needle is smaller than the cross-section of the ejection bore, immediately in front of this ejection bore a throttling of the fuel flow occurs and sharp deflection of said flow on entry into the ejection bore and this causes pronounced turbulences and thus a good fuel atomization and prevents the penetration of the fuel jets up to the combustion chamber wall, especially since the delivery rate is also reduced. This reduction of the delivery rate has the further advantage that during idling or low speed in the lower part-load range during the period of the ignition delay the full fuel amount is not ejected, ejection of a partial amount not taking place until after the ignition, i.e. after combustion has started, giving the desired reduction of the ignition noise. As a further result of the construction according to the invention no pronounced irregularity occurs in the characteristic of the delivery amount. Finally, the production of the nozzle needle or the nozzle body does not present any particular difficulties.

To keep the external diameter of the fuel injection nozzle small in the region of its union nut, thus avoiding installation difficulties with the fuel injection nozzle and in particular ensuring the desired position of the injection nozzle at as acute an angle as possible of the nozzle axis to the cylinder axis of the internal combustion machine, the two helical pressure springs are arranged eccentrically with respect to each other and between them a preferably likewise eccentric sleeve is provided through which extends in the region of its greatest wall thickness the bore for the inflowing fuel.

Since the two helical pressure springs are no longer coaxial but are disposed eccentrically a space is created between them for the eccentric sleeve which in the region of the greatest distance of the two springs from each other can be given an adequately large wall thickness to accommodate the bore for the fuel and have enough strength in the bore region, whereas on the diametrically opposite side it can be made very thin and there require only little space between the springs. However, instead of an eccentric sleeve a sleeve of substantially constant wall thickness may be provided which is then reinforced in the region of the greatest spring spacing for arranging the bore. Since the sleeve no longer surrounds the stronger helical pressure spring it is possible to provide this spring directly within the union nut or the like so that in the region of the spring altogether a substantial reduction of the external diameter of the fuel injection nozzle can be achieved.

To obtain a simple construction and to make it possible that in spite of the sleeve arranged between the springs the stronger outer helical pressure spring can come to act on the stop for the nozzle needle itself loaded by the weaker inner helical pressure spring, as stop for the needle a star-shaped web or a web extending diametrically through the sleeve and passing through the wall thereof in longitudinal slots is provided on which the stronger outer helical pressure spring bears and which comprises a centre bore for the passage of a nozzle needle extension of reduced diameter on which via a spring washer the weaker inner helical pressure spring acts, the end faces of the longitudinal slots of the sleeve limiting the thrust travel of the web.

Figure 2:
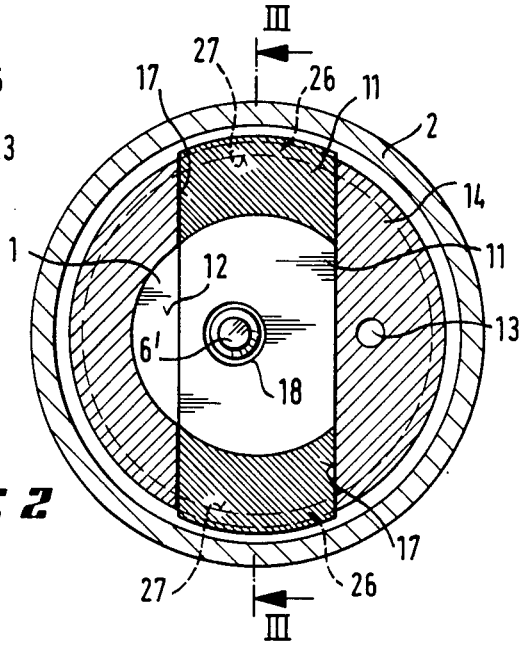

An example of embodiment of the subject of the invention is illustrated in the drawings, wherein:

FIG. 1 shows the parts essential to the invention of a fuel injection nozzle in simplified illustration in axial section, FIG. 2 is a section along the line II—II of FIG. 1, FIG. 3 is a section along the line III—III of FIG. 2 and FIG. 4 is a fragment of the region of an ejection bore of the injection nozzle according to FIG. 1 to a substantially greater scale.

The nozzle body 1 which is connected via a union nut 2 to the remaining device parts terminates in a nozzle cap 3 comprising ejection bores 4. In the nozzle body a nozzle needle 5 is guided which is pressed resiliently against a conical valve seat 6. On an extension 6', of reduced diameter, of the nozzle needle 5 there acts firstly via a spring washer or disc 7 a weaker spring 8 which is surrounded by a substantially stronger spring 9 which bears via a washer 10 and a diametrical web 11 against an end face 12 of the nozzle body 1. The fuel passes from a fuel pump not illustrated via a passage 13 of a sleeve 14 and via a passage 15 of the nozzle body 1 into a collection chamber 16 from where it advances along the nozzle needle 5 up to the valve seat 6.

The two helical pressure springs 8, 9 are arranged eccentrically with respect to each other and between them the sleeve 14 is provided through which in the region of its greatest wall thickness the passage 13 for the fuel supply extends. The web 11 passes through the sleeve 14 in longitudinal slots 17 and has a centre bore 18 for the passage of the reduced-diameter extension 6' of the nozzle needle 5.

If the pump pressure increases the nozzle needle 5 is raised off the valve seat 6 against the force of the spring 8 initially to such an extent that it bears on a face at the lower side of the web 11 acting as stop 19. Now, in this first lifting phase the generated surface M indicated in FIG. 4 of the imaginary cylinder formed in extension of the ejection bore 4 between the inner edge R thereof and the surface of the nozzle needle 5 is to be smaller than the cross-section of the ejection bore 4. On further increase of the fuel pressure the web 11 is then also raised against the force of the spring 9 until engagement with an inner shoulder 20 of the sleeve 14 so that altogether there are two lifting phases for the nozzle needle 5. Of course, the distances which the nozzle needle 5 covers until striking the stop 19 and the web 11 covers until striking the inner shoulder 20 have been greatly exaggerated in the drawings, this also applying to the diameter size of the ejection bores 4.

The nozzle needle 5 is longitudinally displaceably guided in two guides 21, 22 of the nozzle body 1 which are arranged spaced from each other in the region of the upper half of the nozzle needle 5. The upper guide 21 is made substantially shorter than the single guide of a conventional nozzle needle because it is supported and amplified by the lower guide 22 in mounting the nozzle needle 5. Its diameter must be machined accurately to within a few $\mu$ in order to ensure a high-pressure seal of the pressure chamber of the nozzle needle with respect to the space disposed above the needle. Since the lower guide 22 is disposed in the pressure chamber of the nozzle needle, the demands made of the accuracy of its surface are not as high as in the case of the upper guide 21. It is therefore of advantage when only a small length of the nozzle body 1 must be accurately and exactly machined. The guide 22 is as close as possible to the valve seat 6 to ensure a high centering ability of the nozzle needle 5 and prevent bending of the needle. To permit flow of the fuel from the collecting chamber 16 into the passage 23 two diametrically opposite flattened portions 24 and 25 are provided on the outer surface of the nozzle needle 5. This opposite arrangement of the flattened portions 24 and 25 on the nozzle needle 5 ensures an exact centering of the needle by the hydraulic pressure of the fuel. The cross-sectional areas of all the passages traversed by fuel are made of equal size to avoid pressure peaks in the entire nozzle region and to ensure a constant pressure and substantially constant flow speeds of the fuel. This results in a lower material stressing of the individual parts and a higher life of the nozzle. The improved mounting of the nozzle needle as well as the favourable pressure distribution permit a simultaneous opening of all ejection bores 4, giving a uniform distribution of the fuel in the combustion chamber and thus improved emission values.

The web 11 is fitted centered at its lower side with an annular shoulder 26 onto the nozzle body 1. This avoids a jamming of the nozzle needle 5 on the lifting movement thereof in the web 11. The centering face 27 at the shoulder 26 of the web 11 must be larger in the axial direction of the nozzle needle 5 than the travel of the web 11. By the centering of the web 11 with respect to the nozzle body 1 the maximum possible stop area 19 of the nozzle needle 5 at the web 11 is ensured and the tolerances between the individual parts are minimized.

In blind holes 28 and 29 of the sleeve 14 and web 11 respectively locating pins 30 and 31 respectively are inserted which are inserted into bores 32 and 33 respectively of a pump cover 34 and nozzle body 1 to fix the parts in a predetermined position with respect to each other.

We claim:

1. A fuel injection nozzle for internal combustion engines, comprising a nozzle body having a longitudinal axis, a nozzle cap at one end of said nozzle body, said nozzle cap having a fuel ejection bore therein for delivery of fuel to a combustion chamber, said nozzle cap including a valve seat, a nozzle needles guided within said nozzle body along said axis, first and second spring means acting in series to bias said nozzle needle towards said valve seat to close said fuel ejection bores, said nozzle needle being displaceable away from said valve seat in a first displacement phase against the force of said first spring means and a second displacement phase against the force of said second spring means, the outer surface area of an imaginary cylinder formed as a projection from said fuel ejection bores against said nozzle needle when said nozzle needle is displaced away from said valve seat being smaller than the cross-sectional area of said fuel ejection bore throughout said first displacement phase.

2. The fuel injection nozzle of claim 1 further comprising stop means associated with first spring means, said nozzle needle engaging said stop means at the end of said first displacement phase, said stop means being movable against the face of said second spring means during said second displacement phase.

3. The fuel injection nozzle of claim 1 wherein said second spring means is stronger than said first spring means.

4. The fuel injection nozzle of claim 1 wherein said first and second spring means are disposed about said axis.

5. The fuel ejection nozzle of claim 4 wherein said second spring means is disposed about said first spring means.

* * * * *

REEXAMINATION CERTIFICATE (1531st)

United States Patent [19] [11] B1 4,715,541

Freudenschuss et al. [45] Certificate Issued Aug. 13, 1991

[54] FUEL INJECTION NOZZLE FOR COMBUSTION ENGINES

[75] Inventors: Otto Freudenschuss, Vienna; Günther Herdin, Steyr; Harald Schmidt, Vienna; Emerich Schreiner, Steyr, all of Austria

[73] Assignee: Steyr-Daimler-Puch Aktiengesellschaft, Vienna, Austria

Reexamination Request:
No. 90/002,042, Jun. 4, 1990

Reexamination Certificate for:

| | |
|---|---|
| Patent No.: | **4,715,541** |
| Issued: | **Dec. 29, 1987** |
| Appl. No.: | **833,218** |
| Filed: | **Feb. 25, 1986** |

[30] Foreign Application Priority Data

| | | | |
|---|---|---|---|
| Feb. 26, 1985 | [AT] | Austria | 566/85 |
| Nov. 8, 1985 | [AT] | Austria | 3231/85 |

[51] Int. Cl.[5] ..... F02M 45/00
[52] U.S. Cl. ..... 239/533.4; 239/533.9
[58] Field of Search ..... 239/533.5

[56] References Cited

U.S. PATENT DOCUMENTS

| | | | |
|---|---|---|---|
| 1,735,718 | 11/1929 | Attendu | 239/533.5 |
| 3,499,607 | 5/1968 | Thomson . | |
| 3,627,209 | 12/1971 | Scott . | |
| 3,820,723 | 6/1974 | Shipinski . | |
| 4,436,247 | 3/1984 | Akagi . | |
| 4,506,833 | 3/1985 | Yoneda et al. . | |
| 4,516,729 | 5/1985 | Fussner et al. . | |

FOREIGN PATENT DOCUMENTS

| | | |
|---|---|---|
| 195179 | 5/1957 | Austria . |
| 590558 | 1/1934 | Fed. Rep. of Germany . |
| 8505 | 11/1954 | Fed. Rep. of Germany . |
| 1026572 | 3/1958 | Fed. Rep. of Germany . |
| 1041299 | 2/1960 | Fed. Rep. of Germany . |
| 3337891 | 4/1984 | Fed. Rep. of Germany . |
| 3306078 | 8/1984 | Fed. Rep. of Germany . |
| 2373689 | 7/1978 | France . |
| 329505 | 6/1958 | Switzerland . |
| 2093118 | 8/1982 | United Kingdom . |

*Primary Examiner*—Andres Kashnikow

[57] ABSTRACT

A fuel injection nozzle for internal combustion engines comprises a nozzle body (1) and a nozzle needle (5) guided therein. The nozzle body (1) terminates in a nozzle cap (3) in which ejection bores (4) are provided and which forms at the inside a conical valve seat (6) against which the nozzle needle (5) is pressed. The nozzle needle (5) lifts under the pressure of the fuel supplied in a first lifting phase against the force of a spring (8) off the valve seat (6) and bears on a stop (19). This stop (19) is limitedly displaceable in a second lifting phase against the force of a further spring (9). To reduce the hydrocarbon emissions in the exhaust gases of the internal combustion engine and diminish ignition noise, the generated surface (M) of the imaginary cylinder formed in extension of the ejection bore (4) between the inner edge (R) thereof and the surface of the nozzle needle (5) lifted off the valve seat in the first lifting phase is made smaller than the cross-section of the ejection bore (4).

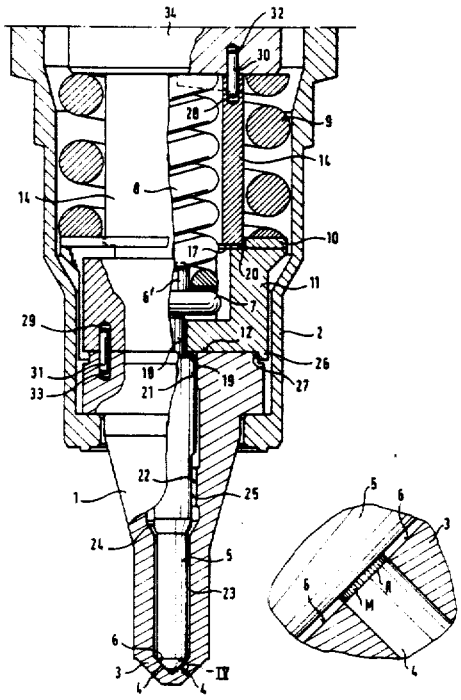

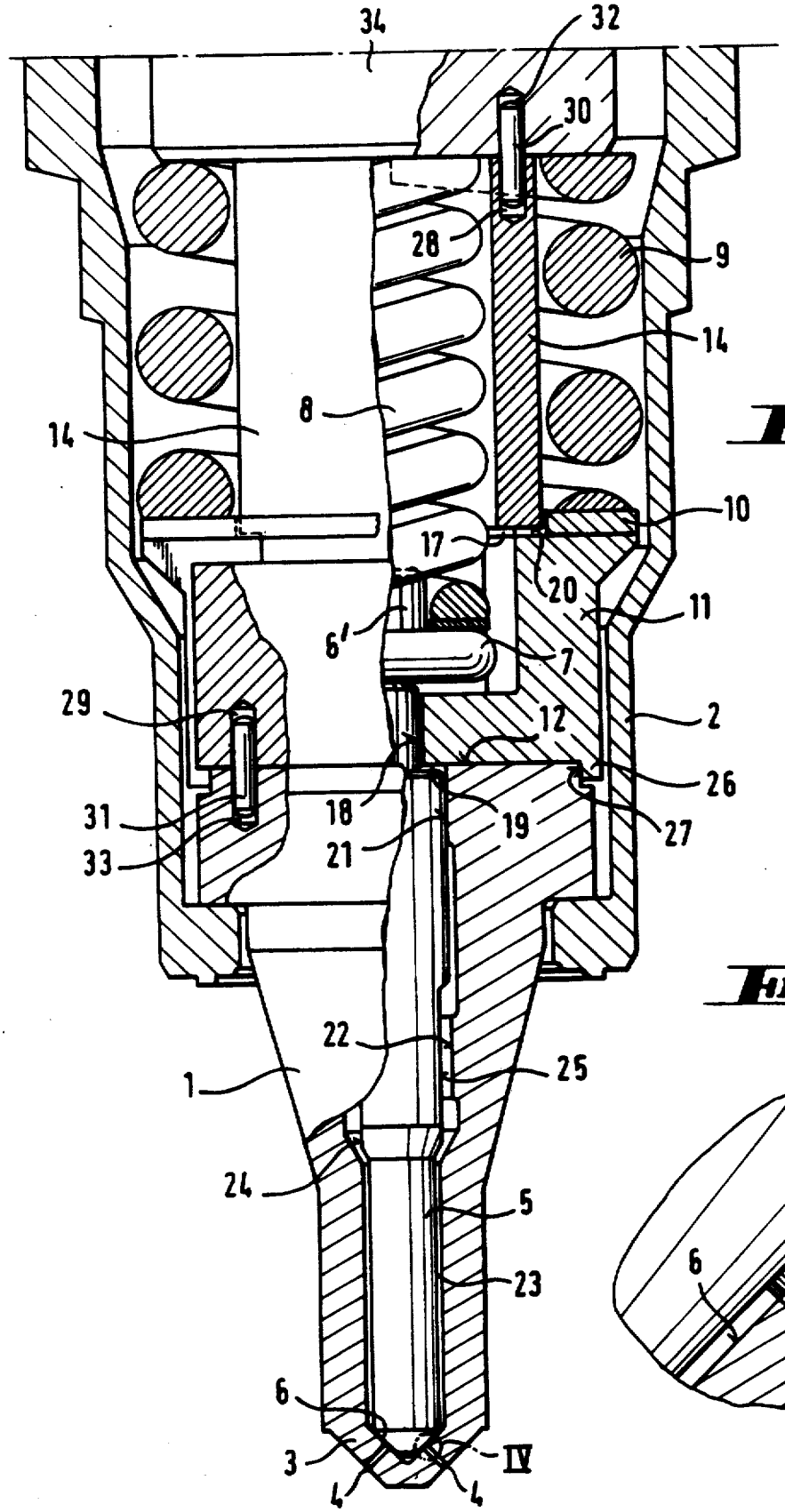
Fig. 3
Fig. 4
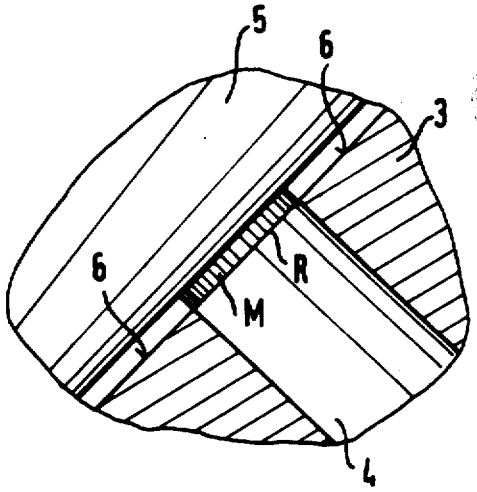

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are determined to be patentable as amended.

Claims 3–5, dependent on an amended claim, are determined to be patentable.

New claims 6–11 are added and determined to be patentable.

1. A fuel injection nozzle for internal combustion engines, comprising a nozzle body having a longitudinal axis, a nozzle cap at one end of said nozzle body, said nozzle cap having a *plurality of* fuel ejection [bore] *bores* therein for the delivery of fuel to the combustion chamber, said nozzle cap including a *conically-shaped* valve seat, a nozzle [needles] *needle* guided within said nozzle body along said axis,

*said fuel ejection bores being disposed along a lateral surface of said conically shaped valve seat, and* first and second spring means acting in series to bias said nozzle needle towards said valve seat to close said fuel ejection bores, said nozzle needle being displaceable away from said valve seat in a first displacement phase against the force of said first spring means and a second displacement phase against the force of said second spring means, the outer surface area of an imaginary cylinder formed as a projection from said fuel ejection bores against said nozzle needle when said nozzle needle is displaced away from said valve seat being smaller than the cross-sectional area of said fuel ejection bores throughout said first displacement phase, *so that during said first displacement phase a throttling of fuel flow occurs immediately upstream of said fuel ejection bores.*

2. The fuel injection nozzle of claim 1 further comprising stop means associated with *said* first spring means, said nozzle needle engaging said stop means at the end of said first displacement phase, said stop means being movable against [the] *a* face of said second spring means during said second displacement phase.

*6. The fuel injection nozzle of claim 1 further comprising first and second longitudinal guide means spaced apart from each other in said nozzle body for guiding the movement of said nozzle needle within said nozzle body.*

*7. The fuel injection nozzle needle of claim 6 wherein said first guide means comprises a high pressure seal.*

*8. The fuel injection nozzle of claim 1 wherein said plurality of fuel ejection bores are distributed about said valve seat so that said all of said fuel ejection bores are opened simultaneously upon initiation of said first displacement phase.*

*9. The fuel injection nozzle of claim 1 wherein all of said fuel ejection bores have the same diameter.*

*10. The fuel injection nozzle of claim 1 further comprising flattened portions disposed symmetrically on an outer surface of said nozzle needle and cooperating with a lower guide of said nozzle body for self-centering of said nozzle needle.*

*11. The fuel injection nozzle of claim 1 wherein said nozzle needle has a conically shaped end.*

* * * * *